US005443572A

United States Patent [19]

Wilkinson et al.

[11] Patent Number: 5,443,572

[45] Date of Patent: Aug. 22, 1995

[54] APPARATUS AND METHOD FOR SUBMERGED INJECTION OF A FEED COMPOSITION INTO A MOLTEN METAL BATH

[75] Inventors: Mark A. Wilkinson, Lexington; Christopher J. Nagel, Wayland, both of Mass.

[73] Assignee: Molten Metal Technology, Inc., Waltham, Mass.

[21] Appl. No.: 162,347

[22] Filed: Dec. 3, 1993

[51] Int. Cl.[6] ..... C22B 7/00

[52] U.S. Cl. ..... 266/46; 110/235; 110/237; 110/238; 266/189; 266/225; 422/159; 422/184; 588/201

[58] Field of Search ..... 266/46, 189, 225; 588/201; 422/129, 184, 159; 110/235, 237, 238

[56] References Cited

U.S. PATENT DOCUMENTS

| | | | |
|---|---|---|---|
| 3,045,997 | 7/1962 | Hudson | 266/225 |
| 3,615,085 | 10/1971 | Bernsmann | 266/34 |
| 3,817,744 | 6/1974 | Leroy et al. | 266/46 |
| 4,394,165 | 9/1983 | Satoh et al. | 75/60 |
| 4,406,443 | 9/1983 | Moriyama | 266/225 |
| 4,574,714 | 3/1986 | Bach et al. | 110/346 |
| 4,602,574 | 7/1986 | Bach et al. | 110/346 |
| 4,750,716 | 6/1988 | Reeve-Parker | 266/225 |
| 4,854,553 | 8/1989 | Labate | 266/266 |
| 5,244,646 | 9/1993 | Stanley | 423/350 |
| 5,282,881 | 2/1994 | Baldock et al. | 75/500 |

FOREIGN PATENT DOCUMENTS

| | | | |
|---|---|---|---|
| 490833 | 2/1976 | U.S.S.R. | 266/22.5 |
| 93/13228 | 7/1993 | WIPO . | |

*Primary Examiner*—Melvyn Andrews
*Attorney, Agent, or Firm*—Hamilton, Brook, Smith & Reynolds

[57] ABSTRACT

A lance for submerged injection of a feed composition, such as a waste, into a molten metal bath includes a perforate refractory tube which extends substantially coaxially about an injection tube. The perforate refractory tube shields the injection tube from the molten metal bath during partial submersion of the lance into the molten metal bath. A perforate support liner extends between the injection tube and the perforate refractory tube and supports the perforate refractory tube. The perforate support liner and the injection tube define an annulus. The method includes conducting a coolant from a coolant source through the annulus to perforations defined by the perforate support liner and the perforate refractory tube, whereby coolant can be directed through the perforations and into the molten metal bath to cause a protective coating of metal to form on the lance. The lance is thereby protected, preserving its structural and chemical integrity during submerged injection of the feed composition through the injection tube into the molten metal bath.

27 Claims, 3 Drawing Sheets

APPARATUS AND METHOD FOR SUBMERGED INJECTION OF A FEED COMPOSITION INTO A MOLTEN METAL BATH

BACKGROUND OF THE INVENTION

Disposal of waste material, which can be hazardous and toxic, in landfills and by incineration has become an increasingly difficult problem because of diminishing availability of disposal space, strengthened governmental regulations and the growing public awareness of the impact of hazardous substance contamination upon the environment. Release of hazardous wastes to the environment can contaminate air and water supplies thereby diminishing the quality of life in the affected populations.

To minimize harmful environmental effects of hazardous waste disposal, methods must be developed to convert these wastes into benign, and preferably, useful substances. In response to this need, there has been a substantial investment in the development of alternate methods for suitably treating such wastes. One of the most promising new methods is described in U.S. Pat. Nos. 4,574,714 and 4,602,574, issued to Bach et al., and includes destroying organic hazardous wastes by dissociating the waste in molten metal. Atomic components of the wastes are reformed in the molten metal to generate environmentally acceptable products, such as hydrogen and carbon oxide gases.

A common method of injecting wastes into molten metal baths is through submerged lances. However, most lances are readily consumed by heat released during exothermic reaction of the waste with oxygen, particularly in the presence of ferro alloys in the molten metal bath. Similarly, lances commonly dissolve during exposure to the high temperature of the metal or metal oxide phase that typically exists in molten baths.

As a consequence, lances are often positioned in the slag phase and above the molten metal, or at a metal/-slag interface. Another attempt to improve the durability of submerged lances is to insulate them with refractory outer layers. However, in order to provide sufficient insulation and chemical protection of the refractory material from attack by molten metal or slag, a coolant must generally also be injected to prevent rapid destruction of the lances. One method of injecting the coolant is through an annular conduit between a central waste composition injection tube and a refractory insulating tube. The coolant is conducted through the annular conduit and is discharged into the molten metal bath through perforations in the refractory tube to thereby cool the lance. However, refractory tubes typically are very brittle and are susceptible to failure in the molten metal bath. Moreover, submersion of the lance deep into the molten metal is important for achieving essentially complete dissolution and consequent enhanced processing of toxic or hazardous waste.

Therefore, a need exists for an apparatus and a method which overcome or minimize the above-mentioned problems.

SUMMARY OF THE INVENTION

The present invention relates to an apparatus and method for preserving the mechanical and chemical integrity of a lance during submerged injection of a feed composition into a molten metal bath, thereby protecting the structural integrity of the lance.

The apparatus includes a lance that has an injection tube for conducting the feed composition through the lance into the molten metal bath. A perforate refractory tube extends substantially coaxially about the injection tube for shielding the injection tube from the molten metal bath during partial submersion into the molten metal bath. A perforate support liner is located between the injection tube and the perforate refractory tube and supports the perforate refractory tube. The perforate support liner and the injection tube define an annulus for conducting a coolant from a coolant source and through the annulus to perforations defined by the perforate support liner and the perforate refractory tube. The coolant can be directed through the perforations and into the molten metal bath, thereby cooling the lance during submerged injection of the feed composition through the injection tube into the molten metal bath.

The method includes directing the feed composition through an injection tube of the lance into the molten metal bath. A coolant is directed from a coolant source and through an annulus defined by the injection tube and perforate support liner. The perforate support liner is substantially coaxial to the injection tube and is located between the injection tube and a perforate refractory tube. The perforate support liner supports the perforate refractory tube. The perforate refractory tube shields the injection tube from the molten metal bath during partial submersion of the lance to the molten metal bath. The coolant is directed through the perforations of the perforate support liner and the perforate refractory tube, and into the molten metal bath, thereby cooling the lance during submerged injection of the feed composition through the injection tube into the molten metal bath.

This invention provides several advantages over known lances employed for submerged injection in molten metal baths. For example, the perforate support liner provides substantial support to the perforate refractory tube, thereby enhancing the durability of the lance. Further, the perforate refractory tube or the perforate support liner, or both, can be porous, or they can have aligned openings, depending on the design requirements of use of the lance. In addition, cooling of the lance causes localized freezing of molten metal at the lance, thereby forming accretions of metal that provide chemical protection of the lance from the molten metal and other contents of the bath. Also, a median tube can be employed, which is placed between the injection tube and the perforate support liner. The median tube causes the coolant to be more efficiently distributed, thereby increasing the cooling effect on the injection tube and further increasing the durability and expected useful life of the lance.

DETAILED DESCRIPTION OF THE INVENTION

The features and other details of the apparatus and method of the invention will now be more particularly described with reference to the accompanying drawings and pointed out in the claims. The same numeral present in different figures represents the same item. It will be understood that the particular embodiments of the invention are shown by way of illustration and not as limitations of the invention. The principal features of this invention can be employed in various embodiments without departing from the scope of the invention.

The present invention relates generally to a lance and a method for submerged injection of a feed composition through the lance into a molten metal bath. A process and apparatus for dissociating a waste composition in a molten metal bath are disclosed in U.S. Pat. Nos. 4,574,714 and 4,602,574, issued to Bach et al. The method and apparatus can destroy, for example, polychlorinated biphenyls and other organic wastes, optionally together with inorganic wastes. The teachings of both U.S. Pat. Nos. 4,574,714 and 4,602,574 are hereby incorporated by reference.

Figure 1:
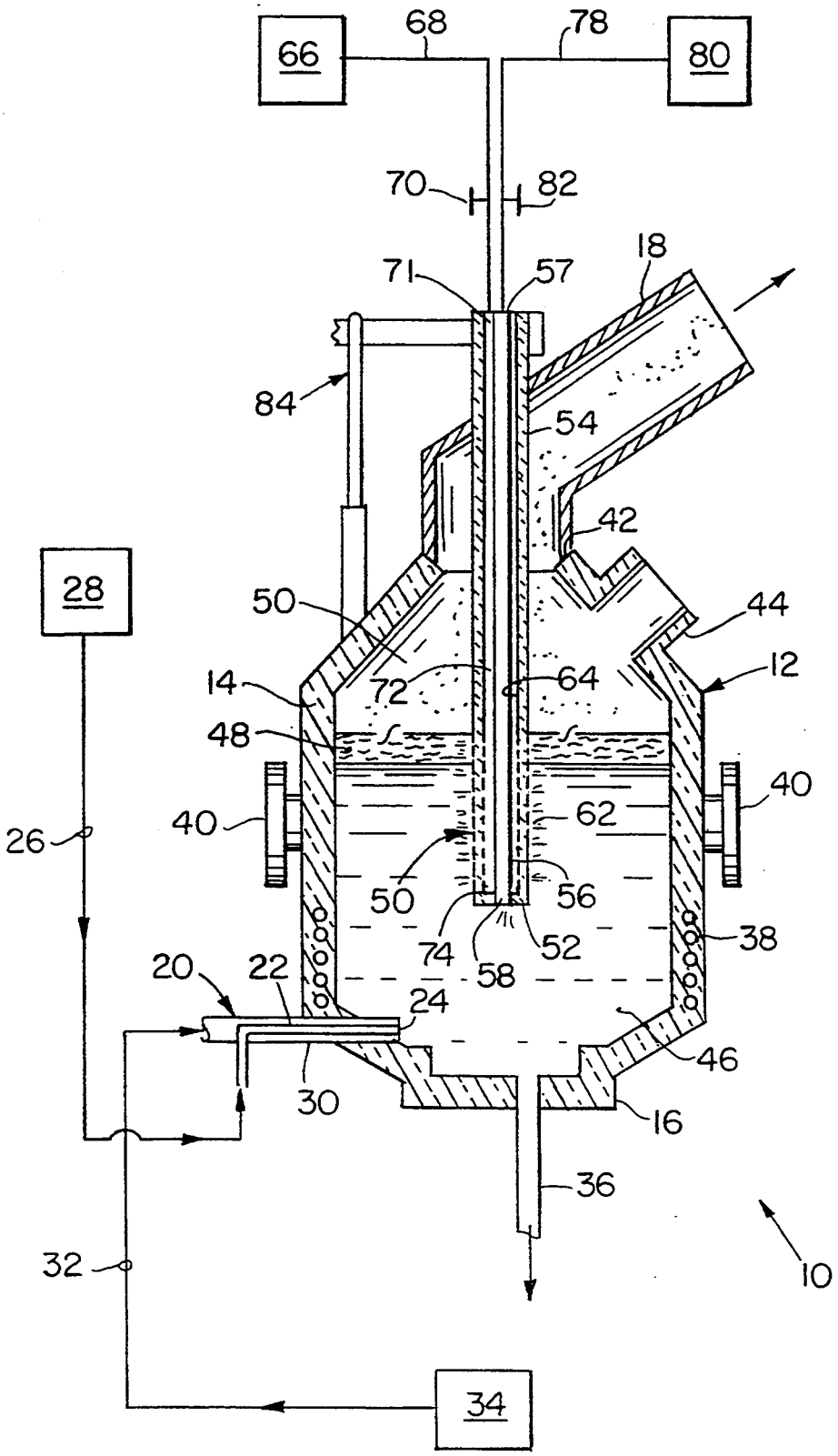
FIG. 1 is a cut-away side elevational view of one embodiment of the lance of the present invention partially submerged in a molten metal bath of a reactor.

One embodiment of the invention is illustrated in FIG. 1. Therein, system 10 includes reactor 12 for containing a molten metal bath suitable for dissociating a feed composition. Examples of suitable reactors include appropriately modified steelmaking vessels known in the art, such as K-BOP, Q-BOP, argon-oxygen decarbonization furnaces (AOD), BOF, etc. Reactor 12 includes upper portion 14 and lower portion 16. Off-gas outlet 18 extends from upper portion 14 and is suitable for conducting an off-gas composition out of reactor 12.

Tuyere 20 is located at lower portion 16 of reactor 12. Tuyere 20, which is a concentric tuyere, includes oxidizing agent tube 22 for injection of a separate oxidizing agent at oxidizing agent inlet 24. Line 26 extends between oxidizing agent tube 22 and oxidizing agent source 28. Outer tube 30 of tuyere 20 is placed concentrically about oxidizing agent tube 22 at oxidizing agent inlet 24. Line 32 extends between outer tube 30 and shroud gas source 34 for conducting a suitable shroud gas from shroud gas source 34 through the concentric opening between outer tube 30 and oxidizing agent tube 22 to oxidizing agent inlet 24. The oxidizing gas, for example, is suitable for oxidizing at least a portion of the feed composition to form a dissociation product, such as carbon monoxide or carbon dioxide. Examples of suitable oxidizing gases are oxygen and air.

Bottom tapping spout 36 extends from lower portion 16 of reactor 12 and is suitable for removal of at least a portion of the contents of reactor 12.

Induction coil 38 is located at lower portion 16 for heating molten metal bath 46 in reactor 12. It is to be understood that, alternatively, reactor 12 can be heated by other suitable means, such as by oxyfuel burners, electric arcs, etc.

Trunions 40 are located at reactor 12 for manipulation of reactor 12. Seal 42 is between off-gas outlet 18 and reactor 12 and is suitable for allowing partial rotation of reactor 12 about trunions 40 for removal of molten metal bath 46 from reactor 12 without breaking seal 42. Feed inlet 44 is suitable for directing a solid feed into reactor 12.

Molten metal bath 46 is formed within reactor 12. Molten metal bath 46 can include metals or molten salt or combinations thereof. Examples of suitable metals include iron, copper, nickel, zinc, etc. Examples of suitable salts include sodium chloride, potassium chloride, etc. Molten metal bath 46 can also include more than one metal. For example, molten metal bath 46 can include a solution of miscible metals, such as iron and nickel. In one embodiment, molten metal bath 46 can be formed substantially of elemental metal. Alternatively, molten metal bath 46 can be formed substantially of metal salts. Molten metal bath 46 is formed by at least partially filling reactor 12 with a suitable metal or salt. Molten metal bath 46 is then heated to a suitable temperature by activation of induction coil 38 or by other suitable means, not shown.

Suitable operating conditions of system 10 include a temperature which is sufficient to at least partially convert carbonaceous feed composition by dissociation to elemental carbon and other elemental constituents. Generally, a temperature in the range of between about 1,300° C. and about 1,700° C. is suitable.

Vitreous layer 48 is formed on molten metal bath 46. Vitreous layer 48 is substantially immiscible with molten metal bath 46. Vitreous layer 48 can have a lower thermal conductivity than that of molten metal bath 46. Radiant heat loss from molten metal bath 46 can thereby be reduced to significantly below the radiant heat loss from molten metal bath 46 where no vitreous layer is present.

Typically, vitreous layer 48 includes at least one metal oxide. Vitreous layer 48 can contain a suitable compound for scrubbing halogens, such as chlorine or fluorine, to prevent formation of hydrogen halide gases, such as hydrogen chloride. In one embodiment, vitreous layer 48 comprises a metal oxide having a free energy of reaction, at the operating conditions of system 10, which is less than that for the reaction of atomic carbon to carbon monoxide, such as calcium oxide (CaO).

Lance 50 extends from upper portion 14 to lower portion 16 of reactor 12. Lance 50 has lower end 52, which is immersed in molten metal bath 46. Upper end 54 of lance 50 extends above molten metal bath 46. Lance 50 has injection tube 56 for receiving the feed composition through injection tube inlet 57 and for directing the feed composition through injection tube outlet 58 into molten metal bath 46. Injection tube 56 has a substantially uniform interior diameter and a substantially uniform wall thickness. The ratio of the outside diameter of lance 50 to the interior diameter of reactor 12 can range from a small to substantial amount. For example, the ratio can have a range of between about 0.05 and 0.9. In one embodiment, the interior diameter of injection tube 56 is about three centimeters, and the wall thickness is about 0.1 centimeters. In another embodiment, the interior diameter of injection tube 56 is about 7.5 centimeters, and the outside diameter of lance 50 is about fifteen centimeters.

Figure 1A:
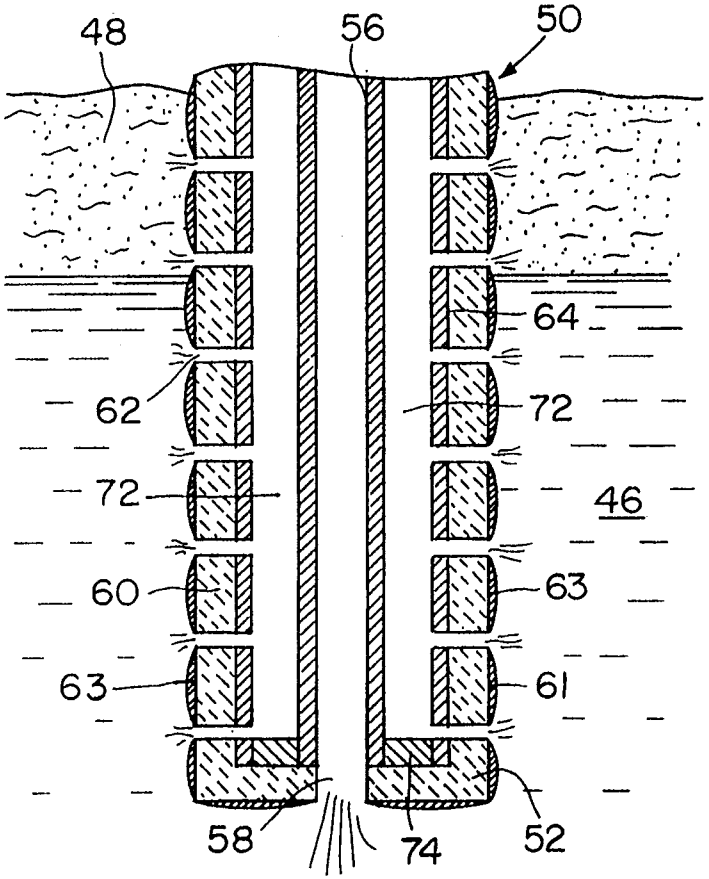
FIG. 1A is a cut-away side elevational view of the submerged portion of the lance as shown in FIG. 1.

As can be seen in FIG. 1A, perforate refractory tube 60 is located substantially coaxially about injection tube 56 for shielding injection tube 56 from molten metal bath 46 during partial submersion of lance 50 into molten metal bath 46. Perforate refractory tube 60 has a series of perforations 62 along the portion of lance 50 which is submerged in molten metal bath 46. In one embodiment, perforations 62 have a diameter in the range of between about 0.05 and 0.1 centimeters each, are spaced about 0.1 centimeters apart and are substantially perpendicular to injection tube 56. In another embodiment, perforations 62 can be directed downward toward lower portion 16 of reactor 12. Further, perforations 62 can be concentrated at the slag/molten interface where significant damage can occur if adequate cooling is not provided. Alternatively, perforate refractory tube 60 is porous. Perforate support liner 64 is placed between injection tube 56 and perforate refractory tube 60 and provides structural support for perforate refractory tube 60. Perforate support liner 64 and injection tube 56 define annulus 72. Perforate support liner 64 includes perforations 62. Fluid communication is provided between perforations 62 and molten metal bath 46 through pores in porous embodiment of perforate refractory tube 60. Alternatively, both perforate refractory tube 60 and perforate support liner 64 can be porous instead of having a series of aligned perforations. Fluid communication is thereby provided between annulus 72 through perforate support liner 64 to surface 61 of perforate refractory tube 60. Annulus 72 is blocked at lower end 52 of lance 50 by block 74. Alternatively, block 74 can also have perforations for cooling.

Referring back to FIG. 1, coolant line 68 extends from coolant source 66 to coolant inlet 71 at annulus 72. The flow of the coolant is controlled by coolant valve 70 at coolant line 68. Feed composition line 78 extends from feed composition source 80 to injection tube inlet 57. The flow of the feed composition is controlled by feed composition valve 82 at feed composition line 78.

Lance 50 is retractable from molten metal bath 46 by lifting means 84 to minimize the exposure of lance 50 to molten metal bath 46 when lance 50 is not in use.

Injection tube 56 is formed of a suitable metal or ceramic. The metal or ceramic of injection tube 56 can withstand the operating conditions of the reactor without significant damage and is also capable of conveying a feed composition at high rates. Further, injection tube 56 is composed of a substance which is not porous to a gas, liquid or comminuted solid feed composition. An example of a suitable metal is stainless steel. An example of a suitable ceramic is alumina.

Perforate refractory tube 60 is composed of a metal, a ceramic, or a combination thereof, that can withstand the operating conditions of the reactor without significant damage. Stainless steel is considered to be a suitable metal, and alumina is considered to be a suitable ceramic.

Perforate support liner 64 is composed of a metal which can withstand the operating conditions of the reactor without significant damage to the lance. An example of suitable metal is stainless steel.

The method includes directing a suitable feed composition, which is received from feed composition source 80, through injection tube 56 of lance 50 from upper end 54 to lower end 52. A suitable feed composition includes waste compositions. Examples of suitable waste compositions are organic chemicals, such as polybrominated biphenyls, polychlorinated biphenyls, dioxins, pesticides, solvents, paints, etc. Other suitable feed compositions include hydrocarbons, such as coal. Radioactive feed can also be processed. The feed composition can be a gas, liquid or solid. The solid can be comminuted, chunks, etc. The feed composition can be mixed with an oxidant, such as oxygen gas. The feed composition enters molten metal bath 46 through injection tube outlet 58. The feed composition substantially dissociates to form at least one dissociation product as it combines with molten metal bath 46 at injection tube outlet 58. Reaction of the feed composition can take place with oxygen present in molten metal bath 46 or with an oxidant that is mixed with the feed composition prior to injection into molten metal bath 46.

A suitable coolant is directed from coolant source 66 through coolant line 68 to annulus 72. An example of a suitable coolant is propane. In another embodiment, the coolant is a gas with liquid droplets of a second coolant, such as an oil. The flow of coolant is controlled by coolant valve 70 to cool lance 50 during the submerged injection of the feed composition into molten metal bath 46. The coolant is conducted through annulus 72 and adjacent to injection tube 56, thereby cooling injection tube 56. Subsequently, the coolant exits annulus 72 through perforations 62 into molten metal bath 46. The coolant can endothermically dissociate upon exposure to molten metal bath 46. The endothermic dissociation occurs proximate to lance 50, thereby further cooling at least a portion of lance 50 and the region proximate to lance 50 during submerged injection of the feed composition through injection tube 56 into molten metal bath 46. During this cooling, it is possible for some of the molten metal proximate to lance 50 to solidify and accrete on surface 61 forming accretion layer 63, thereby providing a protective layer between lance 50 and molten metal bath 46. The coolant is maintained at a pressure in annulus 72 that prevents molten metal bath 46 from entering lance through perforations 62. In one embodiment, the pressure is about 20 psig.

Figure 2:
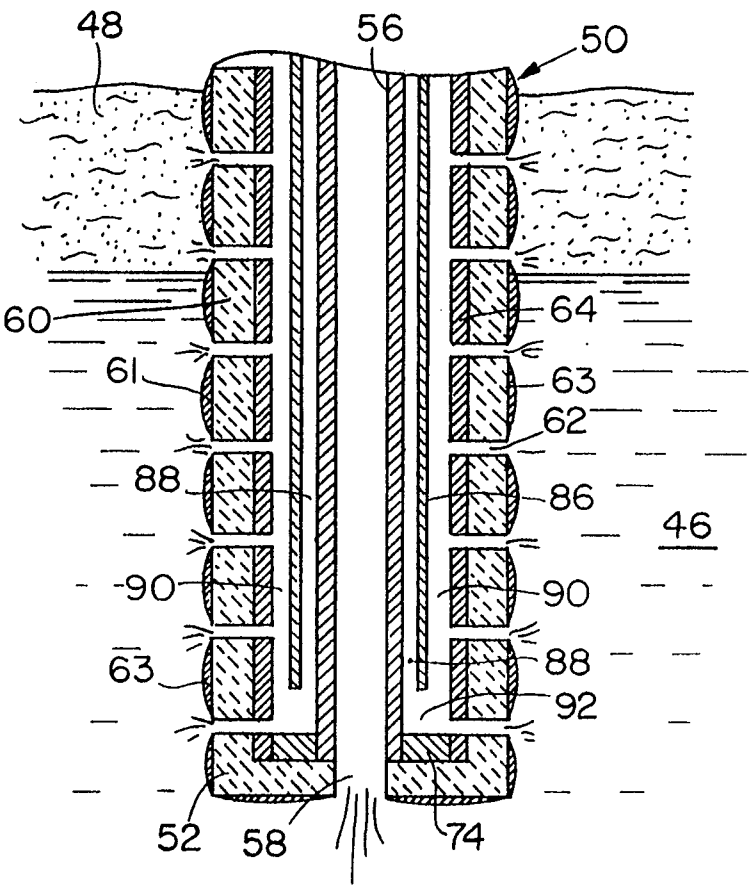
FIG. 2 is a cut-away side elevational view of another embodiment of the submerged portion of the lance, wherein a median tube is located in an annulus between an injection tube and a perforate liner.

FIG. 2 illustrates another embodiment of the invention. The apparatus of FIG. 2 has many of the same elements of FIG. 1A and common components are designated with the same numerals.

As shown in FIG. 2, lower end 52 of lance 50, which is immersed in molten metal bath 46, has injection tube 56 for injecting the feed composition through injection outlet 58 into molten metal bath 46. Perforate refractory tube 60 is placed substantially coaxially about injection tube 56. Perforate support liner 64 provides structural support for perforate refractory tube 60. Perforate refractory tube 60 has a series of perforations 62 around the circumference and along the length of the submerged portion of lance 50.

Median tube 86 is located between perforate support liner 64 and injection tube 56 and extends coaxially and substantially the length of lance 50 to define a conduit which includes inner annulus 88 and outer annulus 90. The coolant is directed from coolant source 66 and coolant line 68 through coolant inlet 71 into inner annulus 88 and is conducted within inner annulus 88 adjacent to a substantial portion of the length of injection tube 56. Injection tube 56 is cooled by flow of the coolant through inner annulus 88. Outer annulus 90 and inner annulus 88 are joined at the lower end of median tube 86 at passage 92. In a preferred embodiment, the coolant is conducted from inner annulus 88 to outer annulus 90. Alternatively, the coolant can be directed from the outer annulus 90 to the inner annulus 88. The coolant is then conducted adjacent to perforate support liner 64, where at least a portion of the coolant is discharged from outer annulus 90 through perforations 62 in perforate support liner 64 and perforate refractory tube 60 into molten metal bath 46. The discharged coolant can dissociate upon contact with molten metal bath 46, thereby cooling lance 50 and causing an accretion of solidified molten metal bath material to form on the surface of submerged lance 50, thereby providing a protective layer on the surface of lance 50. Any remaining gas in outer annulus 90 is conducted through outer annulus 90 and discharged from lance 50 at a coolant outlet, located at upper portion of lance 50. The remaining coolant can then be returned to coolant source 66 or, possibly, vented to the atmosphere.

Figure 3:
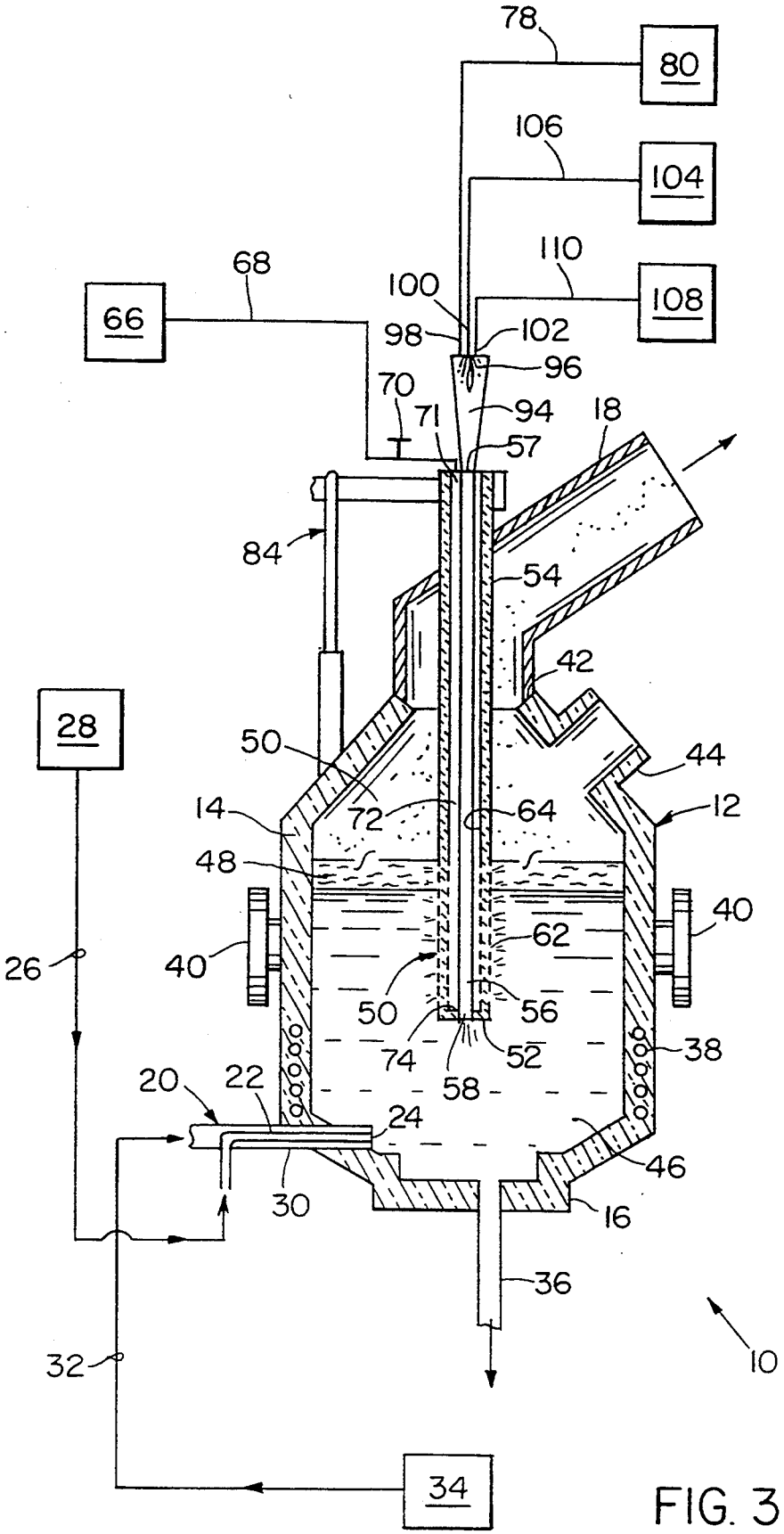
FIG. 3 is a cut-away side elevational view of another embodiment of the lance of the invention which includes an energy source at an upper portion of the lance.

FIG. 3 illustrates another embodiment of this invention. The apparatus of FIG. 3 has many of the same elements of FIG. 1 and common components are designated with the same numerals. In addition to the components of the embodiment illustrated in FIG. 1, the embodiment in FIG. 3 further includes means for heating the feed composition near injection tube inlet 57 at upper end 54 of lance 50.

As shown in FIG. 3, reaction chamber 94 includes energy source 96 and is located at injection tube inlet 57 of lance 50. Reaction chamber 94 is suitable for receiving the combination of a feed composition through feed composition inlet 98, an oxygen gas through oxygen gas inlet 100 and, optionally, a hydrocarbon gas through hydrocarbon gas inlet 102.

Reaction chamber 94 is suitable for at least partially reacting the feed composition before it is injected into molten metal bath 46. The feed composition is received from feed composition source 80 through feed composition line 78 to feed composition inlet 98. Oxygen gas, which can be oxygen or another suitable oxidizer, is received from oxygen source 104 through oxygen line 106. Hydrocarbon gas, which can supplement the reaction of the feed composition by providing additional energy and moderating the temperature of energy source 96, if desired, is received from hydrocarbon gas source 108 through hydrocarbon gas line 110. An example of a suitable energy source includes an oxyfuel burner or a plasma torch.

A feed composition is directed from feed composition source 80 through feed composition line 78 to feed composition inlet 98 with oxygen directed through oxygen inlet 100. The feed composition can be in the form of a gas, liquid sludge, slurry, or solid. Energy source 96 is ignited by ignition means. Energy source 96 preheats and partially reacts the feed composition received from feed composition source 80 in reaction chamber 94 before being directed through lance 50. The formed product is at least partially oxidized to a gas, a non-volatile liquid or solid.

The flow of feed composition, oxygen gas and hydrocarbon gas are controlled by suitable means, also not shown, to cause the gases to react at a desired rate, thereby forming carbon oxides or other reaction by-product gases or both. A hydrocarbon gas and an inert gas can, optionally, be directed from hydrocarbon source 108 and inert gas source (not shown), respectively, to moderate the temperature of energy source 96 and the by-product gases which are formed. A gas is formed which can include carbon dioxide and exerts sufficient pressure on molten metal bath 46 located at lower end 52 to be directed through injection tube outlet 58 into molten metal bath 46.

At least a portion of the components of feed composition and the associated combusted gas substantially dissociate as they combine with molten metal bath 46 at injection tube outlet 58. Subsequently, or simultaneously, the dissociated components are oxidized to form reaction products in molten metal bath 46. The reaction products can dissolve in molten metal bath 46 or, they can escape as solids or gases. Concurrently, coolant is directed from coolant source 66 through coolant line 68 to annulus 72. From annulus 72, the coolant is directed through perforations 62 into molten metal bath 46, thereby cooling lance 50 and a portion of molten metal bath 46 proximate to lance 50.

EQUIVALENTS

Those skilled in the art will recognize, or be able to ascertain using no more than routine experimentation, many equivalents to the specific embodiments of the invention described specifically herein. Such equivalents are intended to be encompassed in the scope of the claims.

We claim:

1. A lance for submerged injection of a feed composition into a molten metal bath, comprising:

a) an injection tube for conducting the feed composition through the lance and into the molten metal bath;

b) a perforate refractory tube, wherein said refractory tube defines the perforations and extends substantially coaxially about the injection tube for shielding the injection tube from the molten metal bath during partial submersion of the lance into the molten metal bath; and c) a perforate support liner located between the injection tube and the perforate refractory tube and supporting the perforate refractory tube, the perforate support liner and the injection tube defining an annulus for conducting a coolant from a coolant source and through the annulus to perforations defined by the perforate support liner and the perforate refractory tube, whereby coolant can be directed through said perforations and into the molten metal bath, thereby cooling the lance during submerged injection of the feed composition through the injection tube into the molten metal bath.

2. A lance of claim 1 wherein the perforate refractory tube is composed of a porous material.

3. A lance of claim 2 wherein the perforate support liner is composed of a porous metal.

4. A lance of claim 3 further including a hydrocarbon inlet at an unsubmerged end of the injection tube.

5. A lance of claim 4 further including a coolant gas inlet at a top portion of the annulus.

6. A lance of claim 5 further including an oxygen gas inlet at the injection tube and proximate to the hydrocarbon inlet.

7. A lance of claim 6 further including means for heating the feed composition near the inlet of said lance.

8. A lance of claim 7 wherein said means for heating includes an oxyfuel burner.

9. A lance of claim 7 wherein said means for heating includes a plasma torch.

10. A lance of claim 8 further including means for retracting the lance from the molten metal bath.

11. A lance of claim 1 for which the ratio of the outside diameter of the lance to the inside diameter of a reactor for containing the molten metal bath is in the range of between about 0.05 and 0.9.

12. A lance of claim 1 further including a median tube placed within the annulus between the injection tube and the perforate support liner, said median tube extending along at least a substantial portion of the lance and defining a conduit, whereby said coolant is conducted within said conduit adjacent to a substantial portion of the length of the injection tube and then adjacent to the perforate support liner, at least a portion of the coolant being discharged from the conduit through the perforation of the support liner and the perforate refractory tube into the molten metal bath.

13. A method for cooling a lance for submerged injection of a feed composition into a molten metal bath, comprising the steps of:

a) directing the feed composition through an injection tube of the lance into the molten metal bath; and b) directing a coolant from a coolant source and through an annulus defined by the injection tube and a perforate support liner, said perforate support liner being substantially coaxial to the injection tube and located between the injection tube and a perforate refractory tube and supporting said refractory tube, said perforate refractory tube defining the perforations and shielding the injection tube from the molten metal bath during partial submersion of the lance in the molten metal bath, whereby coolant is directed through perforations of the perforate support liner and the perforate refractory tube, and into the molten metal bath, thereby cooling the lance during submerged injection of the feed composition through the injection tube into the molten metal bath.

14. A method of claim 13 wherein the coolant includes an inert gas.

15. A method of claim 14 wherein the coolant includes a hydrocarbon.

16. A method of claim 14 wherein the coolant includes a gas with entrained liquid droplets.

17. A method of claim 14 wherein an oxidizing agent and hydrocarbon gas are directed with the feed composition into an upper end of said lance, and wherein the feed composition is preheated by reacting the hydrocarbon gas at said upper end.

18. A method of claim 17 wherein the molten metal bath has a temperature in the range of between about 1,300° and 1,700° C.

19. A method of claim 18 wherein the feed composition is an organic composition.

20. A method of claim 19 wherein the organic composition includes a hydrocarbon.

21. A method of claim 20 wherein the hydrocarbon includes coal.

22. A method of claim 21 wherein the organic composition is comminuted.

23. In a lance for submerged injection of a feed composition into a molten metal bath, said lance including an injection tube, for conducting the feed composition through the lance and into the molten metal bath, and a perforate refractory tube which extends substantially coaxially about the injection tube for shielding the injection tube from the molten metal bath during partial submersion of the lance into the molten metal bath:

the improvement comprising a perforate support liner between the injection tube and the perforate refractory tube and supporting the refractory tube, the perforate support liner and the injection tube defining an annulus for conducting a coolant from a coolant source and through the annulus to perforations defined by the perforate support liner and the perforate refractory tube, whereby coolant can be directed through said perforations and into the molten metal bath, thereby cooling the lance during submerged injection of the feed composition through the injection tube into the molten metal bath.

24. A lance for submerged injection of a waste composition into a molten metal bath, comprising:

a) means for heating the waste composition proximate to the inlet of the lance;

b) an injection tube for conducting the waste composition through the lance and into the molten metal bath; and c) a perforate refractory tube which extends substantially coaxially about the injection tube for shielding the injection tube from the molten metal bath during partial submersion of the lance into the molten metal bath and defining between the injection tube and the perforate refractory tube an annulus for conducting a coolant from a coolant source and through the annulus to perforations defined by the perforate refractory tube, whereby coolant can be directed through said perforations and into the molten metal bath, thereby cooling the lance during submerged injection of the waste composition through the injection tube into the molten metal bath.

25. A lance of claim 24 wherein said means for heating includes an oxyfuel burner.

26. A lance of claim 24 wherein said means for heating includes a plasma torch.

27. A method for protecting the structural and chemical integrity of a lance for submerged injection of a hazardous material into a molten metal bath, comprising the steps of:

a) directing the hazardous material through an injection tube of the lance into the molten metal bath; and b) directing a coolant from a coolant source and through an annulus defined by the injection tube and a perforate support liner, said perforate support liner being substantially coaxial to the injection tube and located between the injection tube and a perforate refractory tube and supporting said perforate refractory tube, said perforate refractory tube shielding the injection tube from the molten metal bath during partial submersion of the lance into the molten metal bath, whereby coolant is directed through perforations which are defined by the perforate support liner and the perforate refractory tube, and into the molten metal bath, thereby protecting the structural and chemical integrity of the lance by forming an accretion on the surface of the partially submerged lance during submerged injection of the hazardous material through the injection tube into the molten metal bath.

* * * * *